United States Patent [19]

Jacobson

[11] Patent Number: 4,601,690

[45] Date of Patent: Jul. 22, 1986

[54] PLASTIC BAG OPENING DEVICE UTILIZING DISPOSABLE MULTILAYER ADHESIVE STRIPS

[76] Inventor: Ralph S. Jacobson, RR 6, 27970 Le Dunne Ave., Aldergrove, British Columbia V0X 1A0, Canada

[21] Appl. No.: 660,911

[22] Filed: Oct. 15, 1984

[51] Int. Cl.[4] ..... B31B 1/78

[52] U.S. Cl. ..... 493/309; 294/99.2

[58] Field of Search ..... 493/255, 256, 309, 312, 493/313, 473, 480, 963; 53/384, 570; 294/99.2; 141/114, 314; 24/304, D11; 427/208, 208.6; 428/343; 51/358

[56] References Cited

U.S. PATENT DOCUMENTS

| | | | |
|---|---|---|---|
| 391,581 | 10/1888 | Carver | 51/358 |
| 2,505,289 | 4/1950 | Haslett | 294/99.2 |
| 2,541,819 | 2/1951 | Hudson | 294/33 |
| 2,610,882 | 9/1952 | Sutliffe | 15/104 A |
| 2,683,274 | 7/1954 | Kappes | 15/106 |
| 4,033,803 | 7/1977 | Coder | 427/208 |
| 4,073,530 | 2/1978 | Seidler | 294/19.1 |
| 4,330,936 | 5/1982 | Swarth | 294/99.2 |
| 4,357,302 | 11/1982 | Giroir | 294/99.2 |

FOREIGN PATENT DOCUMENTS

| | | | |
|---|---|---|---|
| 2642175 | 3/1978 | Fed. Rep. of Germany | 53/384 |

*Primary Examiner*—Francis S. Husar
*Assistant Examiner*—Robert L. Showalter
*Attorney, Agent, or Firm*—Norman E. Reitz

[57] ABSTRACT

A plastic bag opening device has a flexible U-shaped member which can be slipped over the slit edge of a plastic bag. Multilayer adhesive strips are affixed to the inside of the ends of the U-shaped member so as to contact the sides of the plastic bag when the U-shaped member is forced to a closed position. As the U-shaped member is flexed to an open position the sides of the bag adhere to the adhesive substance on the end of each exposed layer so that the sides of the bag are pulled apart from each other.

5 Claims, 7 Drawing Figures

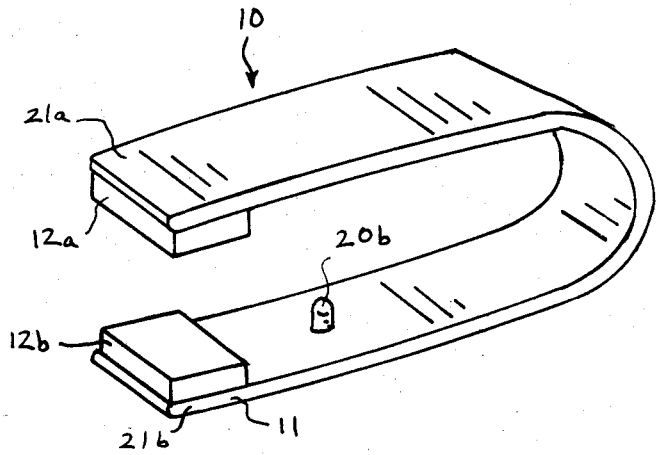
FIG. 1
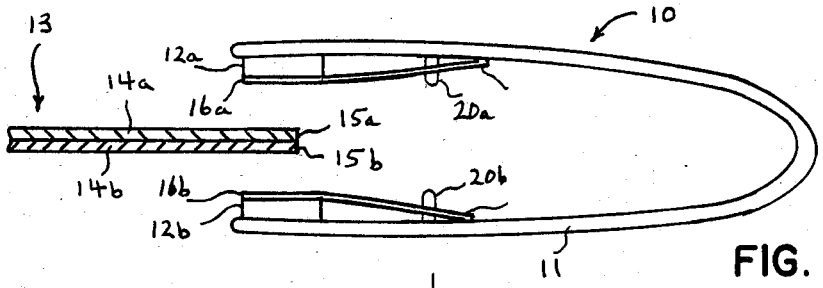
FIG. 2
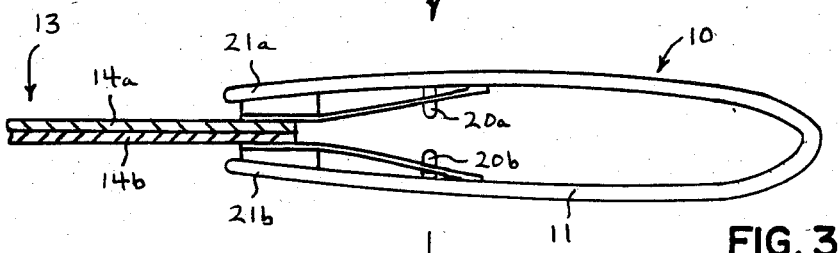
FIG. 3
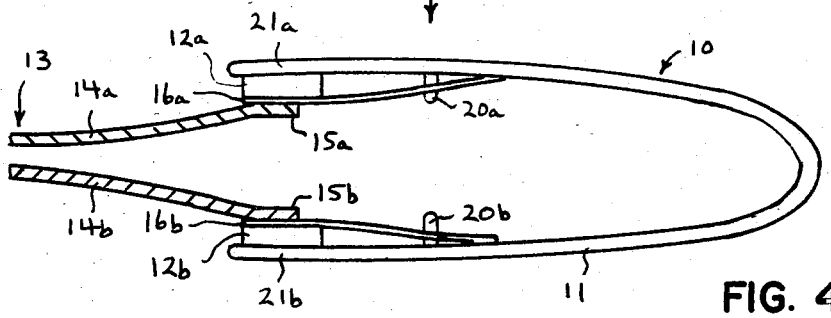
FIG. 4
FIG. 5
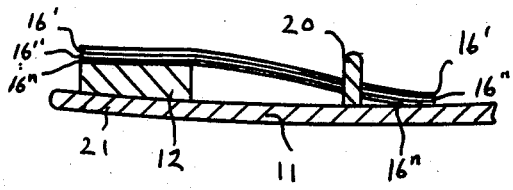
FIG. 5A
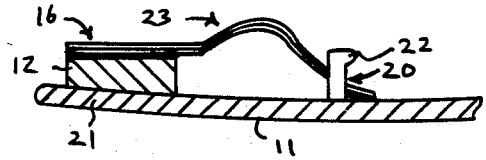
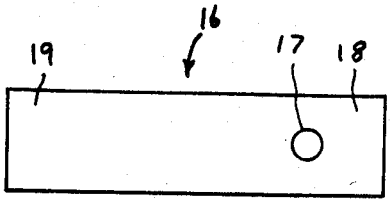
FIG. 6

PLASTIC BAG OPENING DEVICE UTILIZING DISPOSABLE MULTILAYER ADHESIVE STRIPS

This invention to a device for opening plastic bags and, more particularly, relates to a device for adhering to and separating the two sides of a plastic bag along the slit edge to expose the interior volume of the bag.

There has been a trend in the packaging industry towards the use of plastic bags. Thus, it is becoming common to carry consumer goods away from retail outlets in plastic bags of very fine gauge. Such bags may be made from polyethelene, polypropelene and other plastic compounds which have high tensile strength in sheet form even for very thin gauges.

Thin plastic bags have a tendency to stick together due to factors such as the attraction of small charges of static electricity and layer-to-layer surface adhesion. As a consequence, particularly for bags that are supplied in continuous rolls such as poly bags used in produce markets, the consumer often has a difficult time opening the bags. The consumer may spend many seconds or minutes struggling with a poly bag in an attempt to separate the sides of the bag along the slit edge. Once the slightest separation occurs the bag may be completely opened. It is thus a key to the convenient use of poly bags to be able to quickly and easily effect the initial separation of the two sides of the bags.

It is therefore an object of the present invention to provide a device for quickly and easily effecting the separation of the two sides of a plastic bag along the slit edge.

It is another object of the present invention to provide a device which adheres to the two sides of a plastic bag along the slit edge and pulls them apart.

It is yet another object of the present invention to provide a device which nondestructively separates the two sides of a plastic bag.

BRIEF DESCRIPTION OF THE DRAWINGS

For a more complete understanding of the present invention reference may be had to the accompanying drawings which are incorporated herein by reference and in which:

FIG. 1 is a perspective view of the device of the present invention without adhesive means in place:

FIGS. 2–4 are side views of the device of the present invention illustrating their operation in opening a plastic bag in which;

FIG. 2 shows the open end of the device positioned over the slit edge of a plastic bag;

FIG. 3 shows the device contacting the sides of a plastic bag;

FIG. 4 shows the device with the sides of the plastic bag adhered thereto and separated to expose the interior volume of the bag;

FIG. 5 is an expanded side cross sectional view of the forward end of a portion of the device of the present invention;

FIG. 5*a* illustrates alternate embodiment for the nubbin portion of the plastic bag opening device; and FIG. 6 is a plan view of the strip of adhesive means used with the device of the present invention.

SUMMARY OF THE INVENTION

A plastic bag opening device is provided. The device comprises a flexible U-shaped member which can be slipped over the slit edge of a plastic bag. Adhesive means are provided on the inside of the ends of the U-shaped member. As the U-shaped member is flexed to a closed position, the respective adhesive means contact the sides of the plastic bag. Then as the U-shaped member is flexed to an open position the sides of the bag are held by the respective adhesive means and pulled apart from each other. Preferably, the adhesive means comprise a layered strip of adhesive tape so that fresh layers may be uncovered and utilized as the top layer loses adhesive strength.

DESCRIPTION OF THE PREFERRED EMBODIMENT

In the era of high labor costs the consumer is increasingly involved with carrying out tasks that formerly were performed by clerks or service persons. Thus, he pumps his own gasoline, makes repairs on his own home and participates in the task of bagging his own groceries. In virtually all grocery super markets the shopper will select his own fruits and vegetables and place them into plastic bags. He may also be required to scoop out and bag such items as granola, beans, legumes and the like. He is likely to have to tear the bag off a continuous roll placed near the bin where the particular food product is displayed. It is highly desirable that the plastic bag be torn off the roll, opened, filled and sealed with minimum effort and maximum reliability. Unfortunately, the thin gauge bags in widespread use often stick together and are difficult to open.

The device of the present invention is provided to facilitate the opening of thin gauge plastic bags. The device 10 is shown in perspective view in FIG. 1. It is comprised of a resilient U-shaped member 11 fabricated from plastic, stainless steel or like materials which are bendable and resilient. U-shaped member 11 is formed so taht in its unflexed position the ends 21*a* and 21*b* are not in contact and have sufficient opening between themselves to allow the insertion of the slit edge of a plastic bag. Deformable pads 12*a* and 12*b* are attached, respectively, to the inside of the ends 21*a* and 21*b* of U-shaped member 11. As the ends 21*a* and 21*b* are flexed inwardly to contact a plastic bag the pads deform so as to present a flat surface to the sides of the plastic bag, as shown particularly in FIG. 3. Finally, a layered adhesive strip 16, shown in place in FIGS. 2–4, is fitted over nubbin 20 and stretched onto pads 12.

The use of the device of the present invention is shown particularly in FIGS. 2–4. A plastic bag 13 having sides 14*a* and 14*b* is shown with the ends 15*a* and 15*b* of the slit edge being placed in between the ends 21*a* and 21*b* of the device. The sides 14*a* and 14*b* are shown to be in intimate contact. In practice since the the thickness of sides 14*a* and 14*b* is so small it is very difficult to separate the ends 15*a* and 15*b* at the slit edbe by trying to wedge and opening between them. In FIG. 3 the ends 21*a* and 21*b* of U-shaped member 11 are shown to be closed together so that the surfaces of tape 16*a* and 16*b* make contact, respectively, with sides 14*a* and 14*b* of bag 13. Ends 21*a* and 21*b* are closed together, for example, by the thumb and forefinger of a human hand. When the force of closure is removed, U-shaped member 11 returns to its initial position. Thus, the position of U-shaped member 11 in FIG. 4 is the same as the position in FIG. 2. However, the ends 15*a* and 15*b* of bag 13 are now adhered, respectively, to layered tape 16*a* and 16*b*. Consequently, sides 14*a* and 14*b* are pulled apart. The operator can wedge his finger in between sides 14*a* and 14*b* and keep them apart so the bag may be filled.

The device of the present invention utilizes a layered tape 16 so that a fresh adhesive surface can be exposed for use at any time. This is shown particularly in FIG. 5 which is a side cross sectional view of one of the ends 21 of the U-shaped member 11. The tape 16 is shown to be composed of layers 16', 16'' . . . 16$^n$. When the top layer 16' loses its adhesive or becomes contaminated it may be removed by peeling it off, thereby exposing the fresh adhesive surface 16'' and so on.

It is only necessary for the bottom tape, 16$^n$, to have adhesive on both sides since it alone must adhere to the associated deformable pad. The remaining adhesive tapes 16', 16'' . . . 16$^{n-1}$ need only have an adhesive coating on the upper side in the region 19 to make adhering contact with the side of the thin gauge plastic bag. Preferably, region 18 of tape 16 will have no adhesive. As shown in FIG. 6 the hole 17 is sized and positioned to fit over nubbin 20. In a preferred embodiment, shown in FIG. 5*a*, the upper tip of nubbin 20 has a rearward projection 22 which serves to prevent the region 18 of layered tape 16 from inadvertently slipping off nubbin 20. The size of hole 17 can be selected to be large enough to slip over projection 22 and then onto nubbin 20 but not so large as to allow tape 16 to be slipped in a continuous upward motion off nubbin 20. Preferably, the length of layered tape 16 is great enough to permit a slack region 23 so that the top layer of tape can be pulled of the remaining stack by maneuvering the hole 17 in the top layer to the tip of rearward projection 22.

I claim:

1. A device for opening the ends of thin gauge plastic bags, comprising:

a resilient U-shaped member being biased to a normally open position which allows the slit edge of a plastic bag to be positioned between the open ends thereof;

a pair of deformable pads affixed, respectively, to the insides of said ends of said U-shaped member;

a pair of nubbins affixed, respectively, to the inside surfaces of said ends of said relilient U-shaped member inwardly of said deformable pads; and a multilayer adhesive strip stretched over each of said deformable pads and onto said nubbins, at least a portion of the exposed surface of each layer having an adhesive substance thereon to make adhesive contact with respective ones of said ends of said thin gauge plastic bag to allow said bag to be opened as said U-shaped member moves to its normally open position.

2. A device for opening plastic bags in accordance with claim 1 wherein each of said layers have said adhesive substance only at the end which rests on said deformable pad.

3. A device for opening plastic bags in accordance with claim 2 wherein said multilayer adhesive strip has a hole formed on the nonadhesive end thereof so as to fit over said nubbin.

4. A device for opening plastic bags in accordance with claim 3 wherein said nubbin has a rearward projection to prevent said tape from inadvertently slipping off said nubbin.

5. A device for opening plastic bags in accordance with claim 3 wherein said layered tape is of sufficient length to permit a slack section between said deformable pad and said nubbin.

* * * * *